US010392740B2

(12) United States Patent
Chernetski et al.

(10) Patent No.: US 10,392,740 B2
(45) Date of Patent: Aug. 27, 2019

(54) INTELLIGENT DISPENSING IN A LAUNDRY APPLIANCE

(71) Applicant: WHIRLPOOL CORPORATION, Benton Harbor, MI (US)

(72) Inventors: Fredrick E. Chernetski, Saint Joseph, MI (US); Michael T. Dalton, Saint Joseph, MI (US); Karl D. McAllister, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 729 days.

(21) Appl. No.: 15/091,030

(22) Filed: Apr. 5, 2016

(65) Prior Publication Data

US 2016/0215438 A1 Jul. 28, 2016

Related U.S. Application Data

(60) Continuation of application No. 13/449,351, filed on Apr. 18, 2012, now abandoned, which is a division of application No. 12/113,425, filed on May 1, 2008, now abandoned.

(51) Int. Cl.

| | |
|---|---|
| ***D06F 58/10*** | (2006.01) |
| ***D06F 58/20*** | (2006.01) |
| ***D06F 58/28*** | (2006.01) |

(52) U.S. Cl.

CPC ..... *D06F 58/203* (2013.01); *D06F 58/10* (2013.01); *D06F 2058/2854* (2013.01)

(58) Field of Classification Search

CPC . D06F 58/203; D06F 58/10; D06F 2058/2854

See application file for complete search history.

(56) References Cited

U.S. PATENT DOCUMENTS

| | | | | |
|---|---|---|---|---|
| 3,049,905 | A | 8/1962 | Freire | |
| 3,114,653 | A | 12/1963 | Kruzan | |
| 3,933,114 | A | 1/1976 | Horn | |
| 4,236,320 | A | 12/1980 | Schwadike et al. | |
| 4,555,019 | A | 11/1985 | Spendel | |
| 4,642,908 | A | 2/1987 | Brenner | |
| RE33,448 | E | 11/1990 | Bauer | |
| 5,219,371 | A | 6/1993 | Shim et al. | |
| 5,307,651 | A | 5/1994 | Felzer | |
| 5,595,071 | A | 1/1997 | Pasad et al. | |
| H0001676 | H | 9/1997 | Marshall | |
| H001676 | H * | 9/1997 | Marshall | 166/250.08 |
| 6,012,307 | A | 1/2000 | Malchow | |

(Continued)

FOREIGN PATENT DOCUMENTS

| | | | |
|---|---|---|---|
| JP | 09193953 | A | 7/1997 |
| WO | 2007055510 | A1 | 5/2007 |

*Primary Examiner* — Jessica Yuen

(74) *Attorney, Agent, or Firm* — McGarry Bair PC

(57) ABSTRACT

A clothes dryer having a drum having an inner surface at least partially defining a treating chamber in combination with a dispensing system that sprays a fabric-condition substance onto an inner surface of the drum for subsequent distribution to the fabric articles. The dispensing system may have a variable delivery system to vary the distribution pattern of the fabric-condition substance into the treating chamber. The flow characteristic of the fabric-conditioning substance may also be varied as it is dispensed.

19 Claims, 6 Drawing Sheets

(56) References Cited

U.S. PATENT DOCUMENTS

| | | | |
|---|---|---|---|
| 6,898,951 | B2 | 5/2005 | Severns et al. |
| 7,146,749 | B2 | 12/2006 | Barron et al. |
| 2002/0001675 | A1 | 1/2002 | Tisone |
| 2005/0183208 | A1 | 8/2005 | Scheper et al. |
| 2005/0251924 | A1 | 11/2005 | Du Val et al. |
| 2006/0175426 | A1 | 8/2006 | Schramm et al. |
| 2006/0288608 | A1 | 12/2006 | Carow et al. |
| 2007/0151312 | A1 | 7/2007 | Bruce et al. |
| 2010/0115788 | A1 | 5/2010 | Kim et al. |

* cited by examiner

INTELLIGENT DISPENSING IN A LAUNDRY APPLIANCE

CROSS REFERENCE TO RELATED APPLICATIONS

This application is a continuation of and claims the benefit of U.S. patent application Ser. No. 13/449,351, filed Apr. 18, 2012, which is a divisional of U.S. patent application Ser. No. 12/113,425, filed on May 1, 2008, both of which are hereby incorporated by reference.

BACKGROUND OF THE INVENTION

Field of the Invention

The invention relates to an intelligent dispensing system for a clothes dryer and more particularly to the efficient dispensing of water and other chemistries onto fabric articles during the drying cycle.

Description of the Related Art

Contemporary clothes dryer construction includes a cabinet that houses a stationary tub and a rotatable drum mounted within the tub that defines a fabric treatment chamber. A motor is usually coupled to the drum to control rotation of the drum. Both the tub and the drum share an access opening that may be selectively closed by a door. The motor can rotate the drum at various speeds and in opposite rotational directions. A clothes dryer may also include a venting system for circulating air within the drum and venting air to the exterior of the clothes dryer.

Some clothes dryers include a dispensing system for dispensing chemistry or water inside the clothes dryer. For example, a clothes dryer may include a dispenser to spray water, fabric softeners or other fluids into the drum during a drying cycle to prevent wrinkles from forming. As a result of this trend, the ability to accurately and efficiently dispense chemistry inside a clothes dryer is becoming a critical enabler behind increasing overall machine performance and consumer satisfaction.

One problem with the current dryer dispensing systems is the non-uniformity of the chemistry coverage on the fabric articles during dispensing of the chemistry. The current systems often spray the chemistry directly onto the fabric articles, which can lead to non-uniform coverage of the fabric and an inefficient dispensing system. Additionally, since the venting system and the drum are controlled by a single, shared motor, the blower is always actuated when the drum is tumbling. As a result, suspended chemistry particles are vented to the exterior of the machine. The non-uniformity conditions and venting of chemistry usually requires manufacturers to compensate by spraying more chemistry onto the fabric than is necessary. This increase in chemistry may lead to an undesirable stronger than expected scented fabric as well as expensive chemistry waste. Therefore, an improvement over the prior art would be a dispensing system that can provide a uniform application of chemistry onto fabric articles, thereby increasing the efficiency of the dispensing system.

Another problem with prior art dryer dispensing systems is related to clogging of the dispensing system. When chemistries are dispensed into the drum during the drying cycle, the chemistry solvent is driven off. Any residue inside the dispensing nozzle tends to thicken, which can lead to clogging in the dispensing system. Thus, an improvement over the prior art would be a dispensing system that is able to prevent clogging or detect clogging and clean out the system as necessary.

Additionally, current dryer dispensing systems are not intelligent dispensing systems. Typically, the dispensing system is programmed to dispense a fluid at pre-determined times during the drying cycle, but the dispensing system is not able to sense the operating environment and adapt the dispensing mode accordingly. Furthermore, current dryer dispensing systems dispense each type of chemistry in the same manner. However, the optimal dispensing mode may vary depending on the chemistry being dispensed. Therefore, a further improvement over the prior art would be to provide a multitude of spray patterns and flows that react variably according to machine parameters, operating conditions, chemistry type and cycle options.

SUMMARY OF THE INVENTION

Accordingly, in one aspect, the present invention is directed to a clothes dryer having a drum having an inner surface at least partially defining a treating chamber in combination with a dispensing system that sprays a fabric-condition substance onto an inner surface of the drum for subsequent distribution to the fabric articles.

DETAILED DESCRIPTION OF THE EMBODIMENTS

Figure 1:
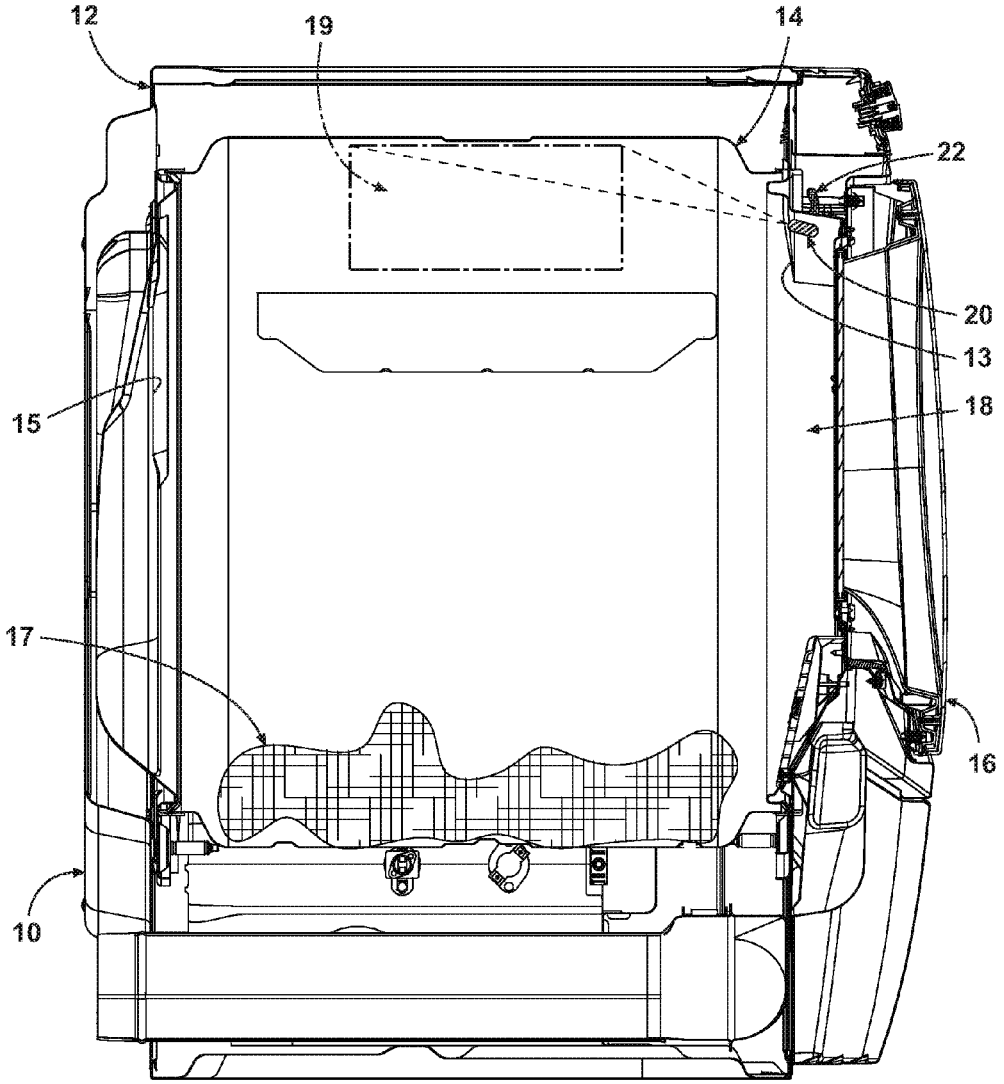
FIG. 1 is a partially cut-away, side elevation view of a clothes dryer having an intelligent dispensing system according to one embodiment of the present invention.

A clothes dryer having an intelligent dispensing system will now be described in detail with initial reference to the illustrative embodiment of the invention as shown in FIG. 1. A clothes dryer 10 may be provided with a cabinet 12 having a door 16 for selectively opening and closing an access opening 18. The cabinet 12 may house a rotatable drum 14 positioned between and in registry with front and rear bulkheads 13 and 15, which collectively define a chamber for drying fabric articles 17. The drum 14 may have a lint screen for removing lint from the fabric articles 17. The clothes dryer 10 may also have a dispenser 20 for dispensing a fabric-conditioning substance into the drum 14 during the drying cycle. The dispenser 20 may be mounted on the front bulkhead 13 through which the access opening 18 extends. The fabric-conditioning substance may be delivered to the dispenser 20 via a conduit 22.

When operated, the drum 14 rotates, thereby tumbling the fabric articles 17 within the drum 14. During the tumbling operation, the fabric articles 17 are generally pushed outwardly to the inner surface of the drum, due to the centrifugal force exerted on the fabric articles 17. However, when the fabric articles 17 reach an upper portion of the drum, as indicated generally by area 19, the fabric articles 17 tend to separate from the drum 14 and fall to the bottom portion of the drum, as shown in FIG. 1, creating a dynamic portion of the drum where no fabric articles are generally present, leaving the inner surface of the drum exposed.

The area 19 of the inner surface of the drum forms a target area on which to spray the fabric-conditioning substance for subsequent transfer to the fabric articles. As a result, the dispenser 20 may be positioned to direct the fabric-conditioning substance towards this area 19. In one embodiment, the dispenser 20 may be positioned adjacent to an access opening of the drum and may be directed upwardly at the area 19. Alternatively, the dispenser 20 may be mounted on the bulkhead 15. It can be readily understood that the position of the dispenser 20 may be changed without altering this aspect of the invention, as long as the dispenser 20 is able to direct the fabric-conditioning substance at area 19. The target area 19 may be of any selected size, location, or configuration so long as liquid is not projected against the bulkhead 15 in the direction of the air inlet, where electrically live parts could be damaged, the outlet where it could foul the lint filter and be wasted, or the drum seals where friction or corrosion could degrade them.

Dispensing a fabric-conditioning substance directly onto an inner surface of the drum and allowing the fabric articles to contact and absorb the fabric-conditioning substance may be more effective in uniformly applying the fabric-conditioning substance to the fabric articles than dispensing the fabric-conditioning substance directly onto the fabric articles. When the dispenser dispenses the fabric-conditioning substance onto the inner surface of the drum, the fabric-conditioning substance may form a band of droplets, covering both the front surface of the drum and the back surface of the drum. Once the band of droplets has formed, the fabric articles may fall against these droplets and absorb them from the inner surface of the drum. This increases the likelihood that more of the fabric articles will be coated by the fabric-conditioning substance. In contrast, when the fabric-conditioning substance may be directed at the fabric articles, the fabric-conditioning substance distribution is limited to the fabric articles that are directly in the path of the dispenser. By dispensing the fabric-conditioning substance throughout the surface of the drum, more of the fabric articles may be able to contact the fabric-conditioning substance. When tested, this method has been found to improve fabric-conditioning substance loss and uniform application by up to approximately 50% as compared to some configurations that dispense directly onto the fabric articles.

The dispenser 20 may also be configured to direct the fabric-conditioning substance at both an inner surface of the drum and directly onto the fabric articles, depending on system conditions and the required application. For example, the dispenser may provide a first spray, such as a directed spray, at the drum surface using a first pressure or a second spray, such as a mist spray, that disperses the fabric-conditioning substance into the drum using a second pressure.

The dispenser 20 may be used to dispense a variety of chemistries or fabric-conditioning substances into the clothes dryer. For example, the fabric-conditioning substance may be a fluid, vapor, powder, or phase changing liquid. More specifically, the fabric-conditioning substance may be water, or various mixtures of fabric softeners, surfactants, builders, emulsifiers, perfume fixatives, perfume binders, perfume carriers, and various other fabric-conditioning substances. These and other chemistries may be used to prevent wrinkles from forming and to remove odors from fabric articles. Thus, any fabric-conditioning substance that aids in odor and wrinkle removal is within the scope of the invention. Additionally, any fabric-conditioning substance that aids in fabric softening, fragrance addition, and anti-static guard may also be used. The dispensing system may also deliver functional finishes, or fabric care additives, such as stain guards and other coatings or chemistries that reduce color loss, fabric shrinkage, and other fabric wear characteristics. Finally, the chemistries may include ingredients to sanitize the clothes load and add other hygienic treatments to the garments being processed. This sanitization chemistry may be coupled with high heat or medium to low heat adding a delicate/gentle sanitization feature to the dryer. In general, it is contemplated that any of a variety of fabric conditioning substances may be dispensed through the system, and the particular chemistry or material is not limiting to the invention.

The dispenser 20 may be a spray nozzle that may provide substantially uniform application of a fabric-conditioning substance onto the fabric articles 17. The dispenser 20 may be a rigid nozzle or may be a flexible nozzle constructed of a material such as silicone, fluorosilicone, ethylene-propylene-diene monomer (EPDM), high density polyethylene (HDPE), metal, polyethylene, low density polyethylene (LDPE), or polystyrene. When a fabric-conditioning substance is delivered to the nozzle using a pump or other pressure source, flexible nozzles may provide spray streams having a higher velocity and lower flow at lower pump speeds compared to conventional rigid nozzles. Additionally, flexible nozzles may provide relatively higher flow rates at higher pump speeds or pressures. Thus, the dispensing mode may be varied based on the required application. If a high velocity, direct spray is required, such as for spraying a fabric-conditioning substance directly onto the fabric articles, the nozzle may be operated at a low pump speed or pressure. In contrast, if a high flow rate is required, the nozzle may be operated at a high pump speed or pressure. Flexible nozzles provide several additional advantages in a clothes dryer application. For example, their compliant nature may enable some designs to close and seal in the absence of pressure, similar to a check valve. As a result, these types of flexible nozzles may not drip excess fabric-conditioning substance into the drum and would potentially prevent or inhibit lint from entering and clogging the nozzle. Furthermore, their compliant nature may prevent clogging of the nozzle. If there is an obstruction in the nozzle, the resulting pressure may cause the nozzle to open around the obstruction to release the pressure. As a result, the pressure may be released at the nozzle orifice instead of allowing it to build and potentially cause a burst elsewhere in the system. Alternatively, the output pressure of the pump may be varied, such as by increasing the voltage to a motor that drives the pump, in order to vary the size of the flexible nozzle opening. As the voltage is increased, the pressure increases, which in turn pushes open the nozzle and creates more flow out of the nozzle.

It can be readily understood that the type of dispenser and the number of dispensers may be changed without altering the function of the invention. For example, there may be any number of nozzles positioned to direct the fabric-conditioning substance upwardly or elsewhere onto an inner surface of the drum at area 19. Furthermore, the dispenser 20 may be movable to provide improved coverage of the inner surface of the drum. In addition to nozzles, other types of dispensers may be used, such as misters, nebulizers, steamers, or any of a variety of other outlet known to those skilled in the art that produces a spray. The dispenser may dispense the fabric-conditioning substance as a continuous stream, a mist, an intermittent stream, or various other spray patterns.

Figure 2:
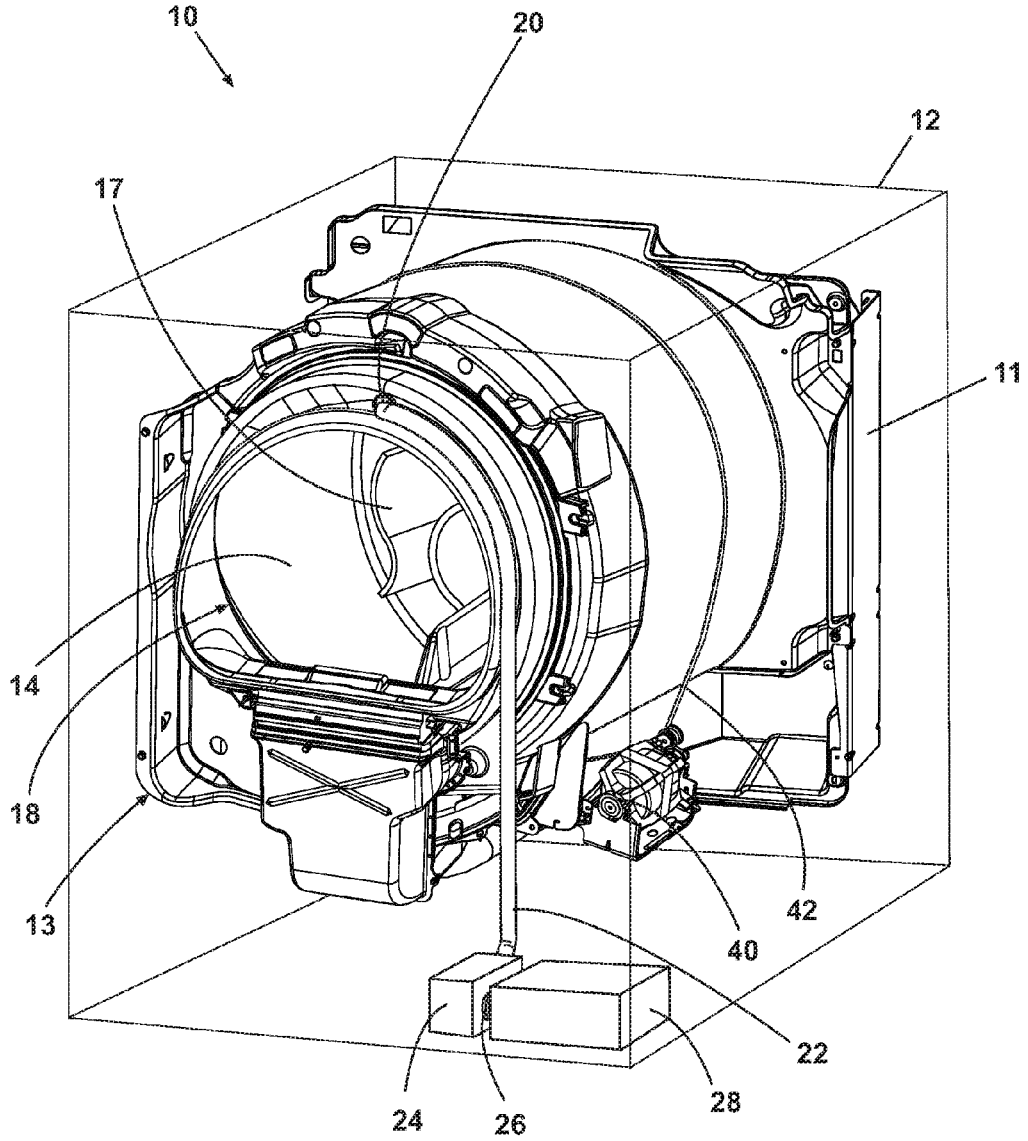
FIG. 2 is a perspective view illustrating a first embodiment of an intelligent dispensing system within a clothes dryer.

Another implementation of the intelligent dispensing system of the present invention is further described with reference to FIG. 2. In the implementation of FIG. 2, a drum 14 may be provided between a front drum panel 13 and rear drum panel 11. In the embodiment shown, the dispensing system includes a dispenser (not shown), a reservoir 28, a delivery apparatus 24, and conduits 22 and 26 for delivering a fabric-conditioning substance from the reservoir to the dispenser 20. Each of these subsystems will be described in detail in the following paragraphs. The reservoir 28 stores the fabric-conditioning substance to be dispensed within the dryer. There may be one or more reservoirs 28 for dispensing multiple types of fabric-conditioning substances. The reservoir 28 may be located in various areas, both internal and external to the cabinet 12. For example, as shown in FIG. 2, the reservoir 28 may be located at the bottom of the cabinet 12.

Figure 3:
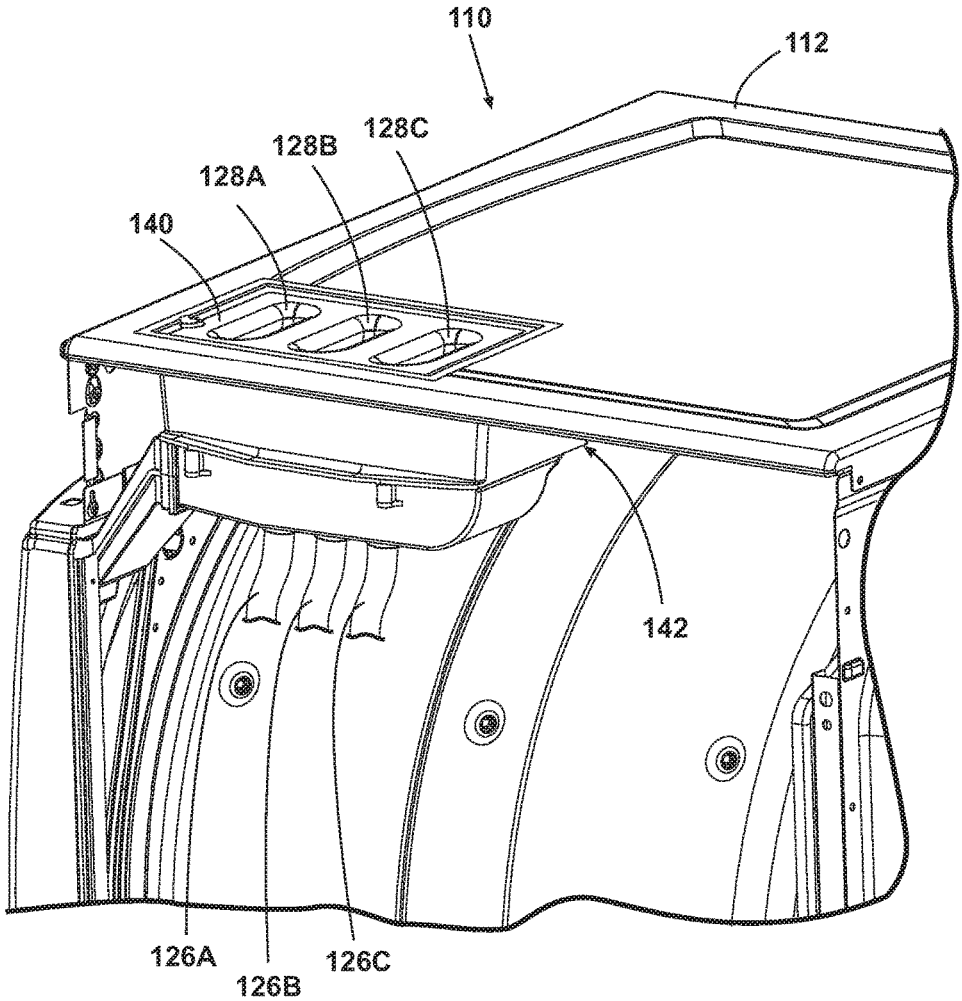
FIG. 3 is a side view illustrating a second embodiment of an intelligent dispensing system within a clothes dryer.
Figure 4:
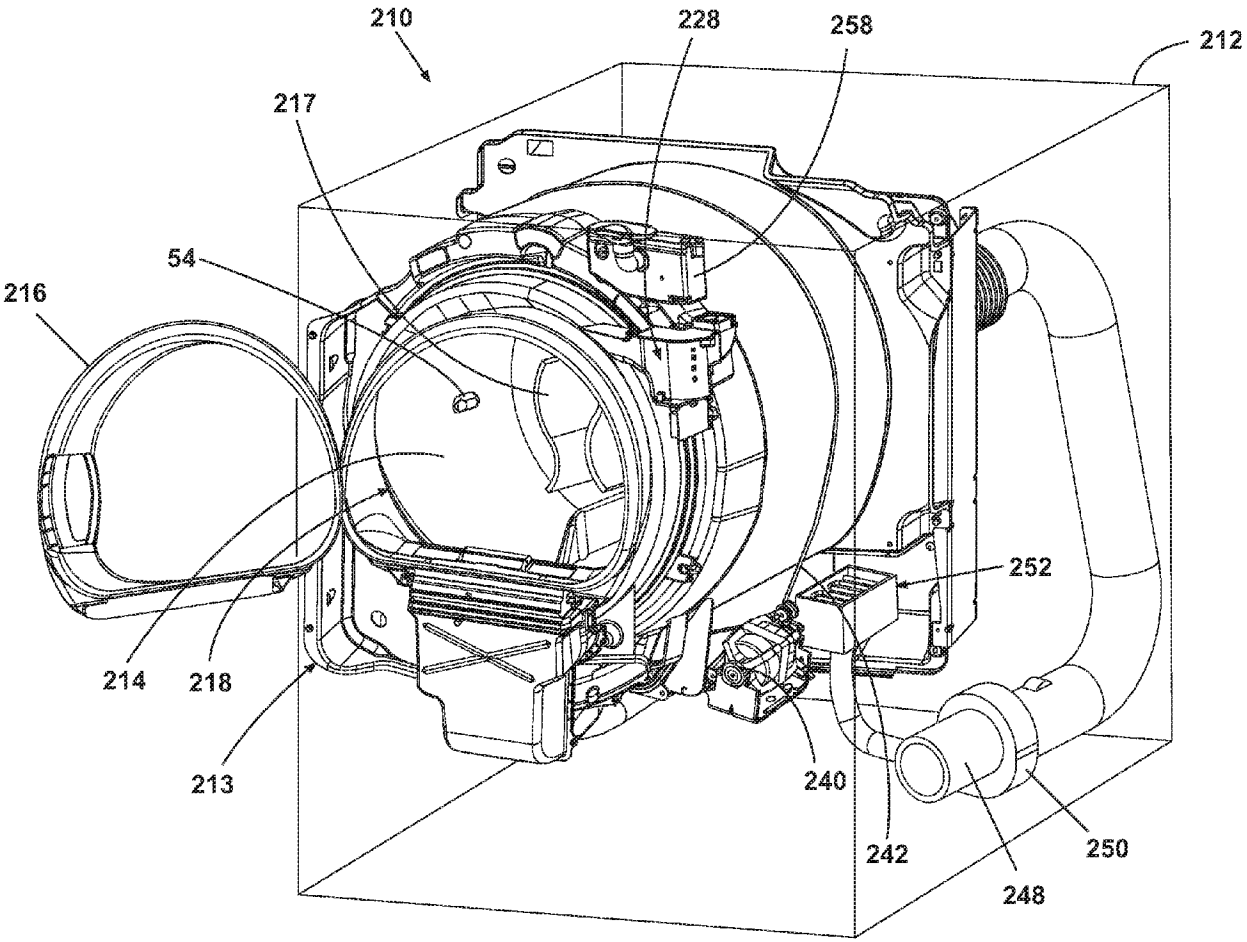
FIG. 4 is a perspective view illustrating a third embodiment of an intelligent dispensing system within a clothes dryer.

For example, as illustrated in the implementation of FIG. 3, three reservoirs, 128*a*, 128*b*, and 128*c*, may be located in the upper portion of the cabinet in a dispensing area 140. The reservoirs 128*a*, 128*b*, and 128*c* may be provided within a housing 142. Three exemplary reservoirs are shown, but it can be readily understood that the number of reservoirs may be changed according to the types of fabric-conditioning substances that may be dispensed. In this embodiment, the reservoirs 128*a*, 128*b*, and 128*c* may be in communication with respective conduits 126*a*, 126*b*, and 126*c*. Alternatively, as shown in the implementation of FIG. 4, the reservoir 228 may be mounted to a bulkhead of the drum. In this embodiment, the fabric-conditioning substance may be gravity-fed to the dispenser. The reservoir 28 may also be provided external to the cabinet 12. In each of the embodiments shown and described, the reservoir 28 may be removably mounted within the cabinet, thus enabling the user to clean the reservoir 28 as necessary.

Referring back to FIG. 2, the reservoir 28 may be various shapes, sizes, and forms. For example, the reservoir 28 may be a refillable container. In this embodiment, the reservoir 28 may include an access opening accessible to the user via a door, flap, or other opening mechanisms. Thus, the user may refill the reservoir 28 as necessary. Alternatively, the entire reservoir 28 may be replaceable, enabling the user to purchase replacement reservoirs 28 that include the fabric-conditioning substance to be dispensed. In the implementation of FIG. 3 the reservoirs 128*a*, 128*b*, and 128*c* are illustrated as cartridges. The cartridges may be disposable or refillable. The reservoir 28 may also be automatically refilled from one or more tanks (not shown) external to the cabinet. Similar to replacing the entire reservoir 28, the user may purchase replacement tanks that include the fabric-conditioning substance to be dispensed. The tanks may be configured to automatically refill the reservoir 28 as required.

Referring again to FIG. 2, the reservoir 28 may include a sensor (not shown) to determine the level of fabric-conditioning substance remaining in the reservoir 28 and be configured to display the fabric-conditioning substance level to the user. For example, the clothes dryer may include a user interface for indicating the level of fabric-conditioning substance in the reservoir, such as low, medium, and high. The level may be indicated using LEDs or similar displays, for example, so the user would know when to refill or replace the reservoir. Alternatively, the user interface may be configured to display an error message when the reservoir is empty using an LED or a buzzer. One sensor system that may be used to determine the level of fabric-conditioning substance remaining in the reservoir 28 may be a series of electrodes. One or more electrodes may be provided within the reservoir 28 and a signal may be measured between these electrodes and a grounded reference electrode. Thus, presence of the fabric-conditioning substance may be detected by the electrodes. Other sensor systems may also be used.

The delivery apparatus 24 may be a variable pressure source, such as a pump, or a variable flow source, such as a blower. The pump may be a variable speed pump, such as an impeller based pump, a peristaltic type pump, or various other types. As shown in the implementation of FIG. 2, the delivery apparatus 24 may be connected to the reservoir 28 using a conduit 26. Additionally, the delivery apparatus 24 may be connected to the dispenser using a conduit 22 and a mounting mechanism 30, which also provides a sealed entry for the conduit 22 into the drum 14.

Figure 5:
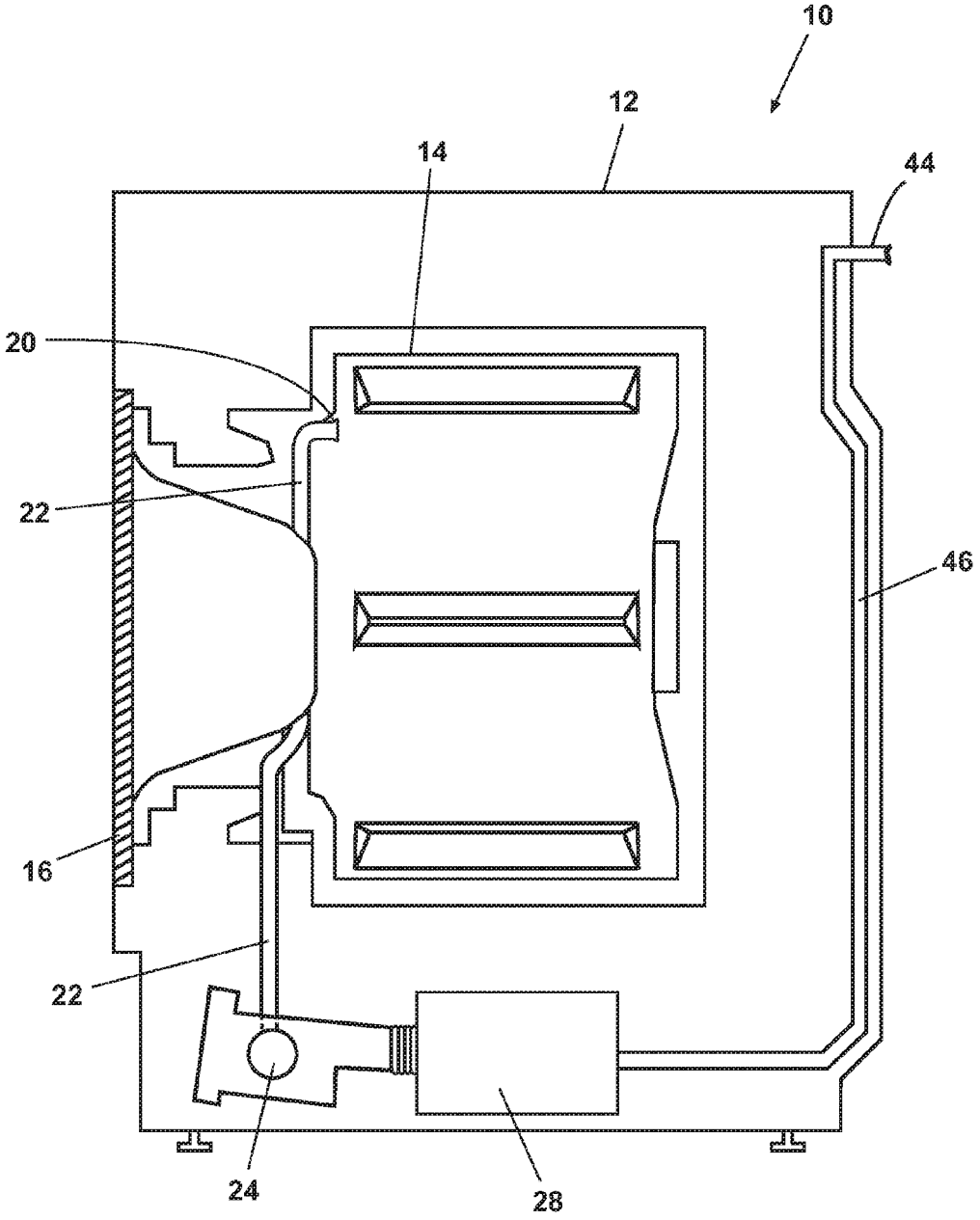
FIG. 5 is a fragmentary perspective view of an embodiment of a dispensing fabric-conditioning substance storage system.

Alternatively, as shown in the implementation of FIG. 5, the reservoir 28 may be coupled with a household water line 44 via a conduit 46. The conduit 46 delivers water to the reservoir 28 and the delivery apparatus 24 delivers water to the dispenser 20 via conduit 22. Alternatively, the household water line 44 may be coupled directly with the dispenser 20. Additionally, there may be a valve provided between the household water line 44 and the reservoir 28 to control the amount of water entering the dispensing system. Furthermore, a pump may be added to the household water line 44 to further control the flow rate and spray pattern of the dispenser 20.

Figure 6:
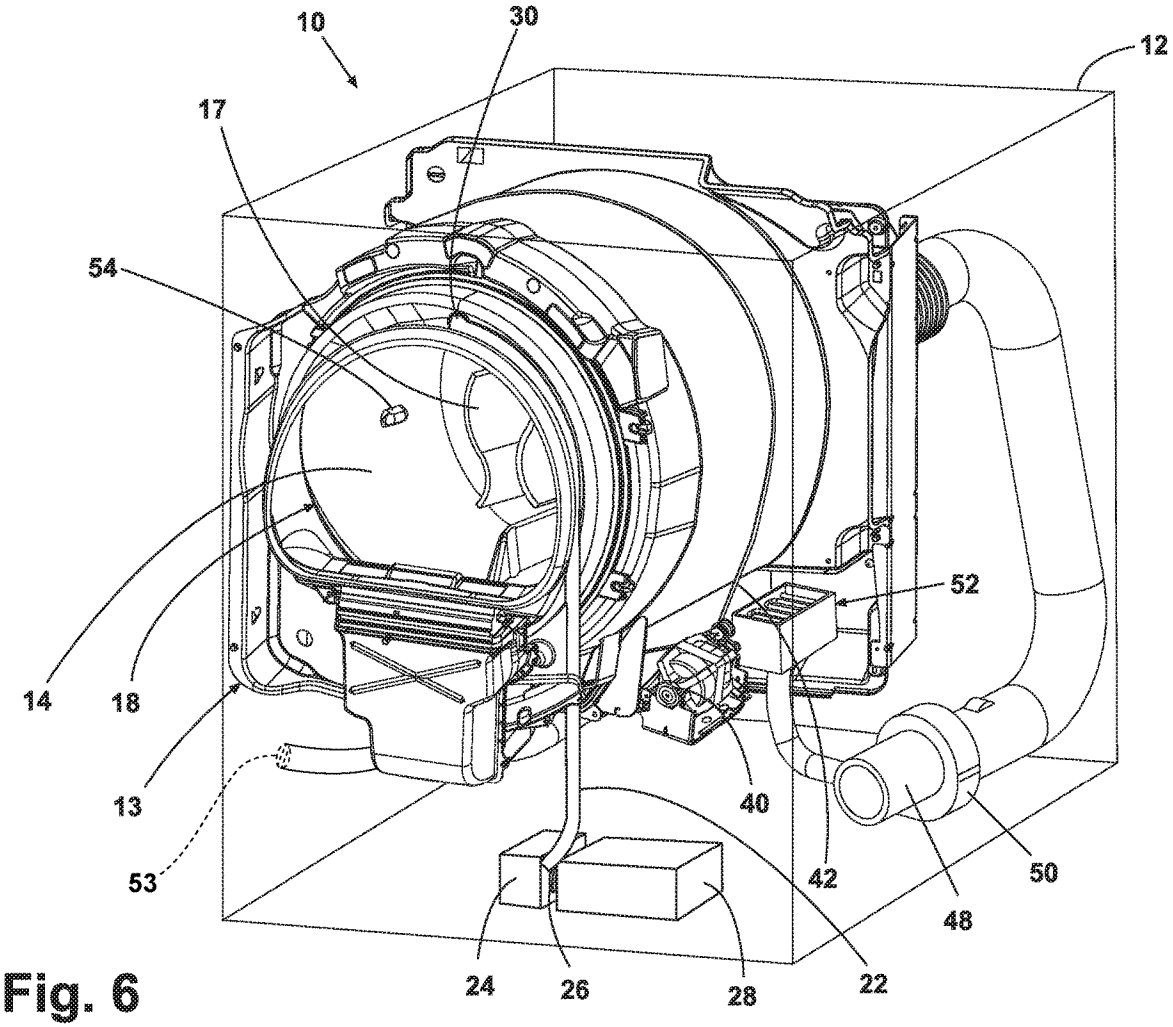
FIG. 6 is a perspective view according to a fourth embodiment of an intelligent dispensing system within a clothes dryer.

Another implementation of the dryer with an intelligent dispensing system is illustrated in FIG. 6. A clothes dryer 10 may be provided with a cabinet 12 that houses a rotatable drum 14. The drum 14 has an access opening 18 and defines a chamber for drying fabric articles 17. The cabinet 12 also houses an air flow system, including a blower fan 50, a blower motor 48, a heater 52, and a vent 53. The blower motor 48 controls the air flow system, and when actuated, the blower fan 50 circulates air throughout the drum 14 to facilitate drying of the fabric articles 17. Typically in most dryer models, a single motor is used to control the air flow system and rotation of the drum. As a result, when the fabric articles are tumbling within the drum, the blower fan is always turned on, which causes suspended fabric-conditioning substance particles to vent to the outside air, external to the dryer.

In other embodiments of the invention, a separate drum motor 40 may be used to control rotation of the drum 14 via a belt 42. Thus, the drum 14 and blower fan 50 are controlled independently and the fabric-conditioning substance being dispensed may be directed at the drum 14 or the fabric articles 17 while the blower fan 50 is off. Thus, there may be reduced fabric-conditioning substance loss through the venting system. The separate motors for the drum and blower may be variable speed, enabling unconventional tumble speeds and tumble durations of the drum 14. Additional embodiments of the invention may enable the drum 14 to manipulate the fabric articles 17 by reversing the drum rotation instead of utilizing a continuous rotation in one direction. Additionally, the drum 14 may have a variable rotation time and pause time, including rotation in both directions. The drum motor 40 may also move the drum back and forth in successive motion with high acceleration and deceleration capabilities. The increased flexibility in drum 14 movement and reduced fabric-conditioning substance loss may lead to improved drying of fabric articles 17 and increases the likelihood of the fabric articles being sprayed consistently. Another advantage of using separate motors to control the drum 14 and the air flow system is that the air flow system may be controlled to prevent venting of air when the dispenser 20 is dispensing a fabric-conditioning substance. This further increases the likelihood that the fabric-conditioning substance will be absorbed by the fabric articles 17 and will not be vented external to the dryer 10. The air flow system may also be included in the embodiments previously described. The above features may be combined with various sensing systems, such as sensors to determine load size, load type, and the type of fabric-conditioning substance being dispensed, in order to further optimize performance. Exemplary sensing systems will be described in the following paragraphs.

Another embodiment of the invention may include a recirculation loop for redistributing air within the drum. The recirculation loop may include a conduit having an outlet leading from the drum and an inlet leading back into the drum. With this configuration, the vent 53 may be closed and the recirculation loop opened. Thus, any fabric-conditioning substance carried away by the air stream through the recirculation loop may be recirculated back into the drum, giving the fabric-conditioning substance another opportunity to be absorbed by the fabric articles.

In each of the embodiments described, the delivery apparatus 24 may be an intelligent source that may improve fabric-conditioning substance delivery under a variety of operating conditions. As a result, the delivery apparatus 24 may provide a multitude of spray patterns and flows that react variably according to machine parameters and cycle options. For example, the duty cycle of the delivery apparatus 24 may be varied in order to vary the dispensing mode of the fabric-conditioning substance. Varying the duty cycle of the delivery apparatus 24 enables a variation in the "on" time and "off" time of the dispenser, creating a condition in which the dispenser 20 may be pulsing to dispense the fabric-conditioning substance. The pulsing may enable fabric-conditioning substance droplets to carry to the back side of the drum when the delivery apparatus is "on." As the pressure diminishes, the front side of the drum may also be coated by the fabric-conditioning substance. Thus, the dispenser 20 may be controlled to dispense the fabric-conditioning substance so that it intermittently impinges upon an inner surface of the drum 14, thereby distributing the fabric-conditioning substance axially within the drum 14. This may improve the likelihood of uniformly covering the fabric articles 17 within the drum 14 and prevent over-saturation. Additionally, pulsing may aid in the prevention of clogging of the dispenser 20. Furthermore, pulsing may also create a variety of droplet sizes that may improve surface coating of the drum 14 and fabric fabric-conditioning substance absorption. The pulsing of the dispenser 20 may be controlled by using fast, slow, random, or other variations of the duty cycle.

Similarly, the speed of the delivery apparatus 24 may be varied in order to vary the dispensing mode of the fabric-conditioning substance. Varying the speed of the delivery apparatus 24 enables variation in the pressure of the fabric-conditioning substance as it is dispensed. When a pump is used as the delivery apparatus 24, the speed of the pump affects the spray pattern of the fabric-conditioning substance. For example, at lower pump speeds the fabric-conditioning substance will be dispensed at a lower pressure. As a result, the total exit flow of the fabric-conditioning substance decreases, but the flow pattern may also change, likely having a decreased spray angle and exit velocity. This flow pattern may be beneficial when there is a need to soak fabric articles 17 that are passing directly in front of a dispenser 20 with a heavy, concentrated flow. In contrast, at higher pump speeds and therefore higher pressure, the fabric-conditioning substance will typically exit at a higher velocity and greater flow angle. As a result, the spray pattern will be more spread out and may be used to project the fabric-conditioning substance droplets further into the drum 14. Variation in the speed of the delivery apparatus 24 may further improve the likelihood of uniformly covering the fabric articles 17 within the drum.

Furthermore, the delivery apparatus 24 may be configured to respond to various user settings, such as the user's preferred dispensing mode, and to additional feedback from the dryer, such as machine parameters, cycle parameters, fabric-conditioning substance type, load size, fabric type, and various other factors. For example, the optimal dispensing parameters for one type of fabric-conditioning substance may be different from another type of fabric-conditioning substance. Thus, the dryer may include a sensor to determine the type of fabric-conditioning substance being dispensed. In one embodiment, a sensor may be provided within a conduit through which the fabric-conditioning substance travels and the type of fabric-conditioning substance may be determined by a conductivity measurement from the sensor. In the case of a multiple reservoir system similar to the system illustrated in FIG. 3, a sensor (not shown), such as an electrode pair, may be placed in each conduit 126*a*, 126*b*, and 126*c* associated with the reservoirs 128*a*, 128*b*, and 128*c*. Each reservoir may hold a designated type of fabric-conditioning substance and thus when the fabric-conditioning substance completes the circuit between the electrode pair, the machine may determine which fabric-conditioning substance is being dispensed. The described sensors are exemplary; other types of sensors, such as RFID, for example, may be used without altering the function of the invention, or the information may be indicated by the user on the user interface, for example. Once the machine knows the type of fabric-conditioning substance to be dispensed, the duty cycle and speed of the delivery apparatus 24 may be selected according to the characteristics of the fabric-conditioning substance.

The delivery apparatus 24 may also have flexibility in adapting the fabric-conditioning substance flow based on the preferred application method. In some situations, the dispenser 20 may be controlled to direct a fabric-conditioning substance onto an inner surface of the drum 14, whereas in other situations the dispenser 20 may be controlled to direct a fabric-conditioning substance at the fabric articles 17. In order to accomplish this, a machine sensor or user-defined information may be monitored by the machine's controller. For example, the controller may monitor factors such as load size, humidity level, temperature, cycle selected, dryness of the fabric articles, fabric type, drum size, drum geometry, and various other factors. The delivery apparatus 24 and resulting spray characteristics may then change accordingly. For example, as shown in the embodiment illustrated in FIG. 4, a sensor 54 may be provided within the drum 214. The sensor 54 may be a humidity sensor, a temperature sensor, or an electrode that monitors the dryness of the fabric articles 217 as they fall against the sensor 54. Feedback from the sensor 54 may dictate the characteristics of the delivery apparatus 24 and thereby the dispenser 20. It can be readily understood that other types of sensors may be used without changing the function of the invention. Additionally, multiple sensors may be used.

To further improve the efficiency of the dispensing system, the delivery apparatus 24 may be configured to remove residual fabric-conditioning substance from the dispenser 20 after the fabric-conditioning substance has been dispensed. In an exemplary system including a nozzle as the dispenser 20 and a pump as the delivery apparatus 24, if the reservoir 28 is located below the nozzle, atmospheric venting may cause the fabric-conditioning substance to retract from the nozzle. Alternatively, reversing the direction of the pump after each cycle when the nozzle is used may cause the fabric-conditioning substance to retract from the nozzle. If the reservoir 28 is located above the nozzle, reversing direction of the pump after each cycle using the nozzle may cause the fabric-conditioning substance to retract from the nozzle. Thus, residual fabric-conditioning substance may be removed from the nozzle, thereby aiding in the prevention of clogging. Additionally, the nozzle may be removable or replaceable, so the user is able to clean or replace the nozzle as desired.

In each of the above described embodiments, the clothes dryer may include a user interface for displaying information related to the dispensing system. For example, the user interface may notify the user when a fabric-conditioning substance is being dispensed into the drum. The user interface may accomplish this by displaying a message, illuminating an LED or other light display, actuating a buzzer, or by various other methods that are evident to one of skill in the art. Additionally, the user interface may display the type of fabric-conditioning substance being dispensed or the resulting treatment to the fabric articles. For example, the user interface may display that the dryer is executing a wrinkle removal cycle, an odor removal cycle, a fragrance addition cycle, an anti-static guard cycle, a stain guard cycle, or various other cycles that are within the scope of this invention.

In operation, the intelligent dispensing system may vary the flow characteristics of the fabric-conditioning substance as it is dispensed through the dispenser 20, according to various user settings and feedback from the machine. In addition to varying the flow characteristics of the fabric-conditioning substance, other types of cycle optimization may occur in response to the various sensors in the machine. For example, the machine temperature may be adjusted. Additionally, the fabric articles may be heated during the drying cycle in order to drive entrained fabric-conditioning substance into the fabric articles, thus improving absorption. Furthermore, the fabric-conditioning substance may be dispensed at specific moments during the drying cycle where it will be the most effective. The above optimizations are designed to enhance spray uniformity, prevent fabric-conditioning substance loss and improve the efficiency of the dispensing system.

While the present invention has been described with reference to the above described embodiments, those of skill in the art will recognize that changes may be made thereto without departing from the scope of the invention as set forth in the appended claims.

What is claimed is:

1. A dryer, comprising:

a rotatable drum at least partially defining a chamber for drying fabric articles;

an airflow system, having a blower fan and a blower motor, configured to selectively provide air to the rotatable drum;

a dispensing system, comprising:

multiple reservoirs configured to store a corresponding number of fabric-conditioning substances; and a nozzle, fluidly coupled to the rotatable drum, and configured to dispense at least one of the fabric-conditioning substances into the rotatable drum; and a controller operably coupled to the dispensing system and configured to control dispensing of the at least one of the fabric-conditioning substances based on a type of the at least one of the fabric-conditioning substances.

2. The dryer of claim 1 wherein the airflow system further comprises a vent configured to selectively vent air external of the airflow system.

3. The dryer of claim 2, further comprising a recirculation loop selectively fluidly connected to the airflow system and having an outlet leading from the rotatable drum and an inlet leading to the rotatable drum.

4. The dryer of claim 3 wherein the controller is further operably coupled to the airflow system and configured to fluidly connect the recirculation loop to the rotatable drum and close the vent during operation of the dispensing system.

5. The dryer of claim 4 wherein the controller is configured to control the dispensing system to selectively direct the at least one of the fabric-conditioning substances at an inner surface of the rotatable drum or directly onto fabric articles within the rotatable drum.

6. The dryer of claim 1 wherein the controller is further operably coupled to the blower motor and configured to selectively cease operation of the blower motor during dispensing of the at least one of the fabric-conditioning substances.

7. The dryer of claim 1 wherein the dispensing system further comprises a steam dispenser.

8. The dryer of claim 1, further comprising a first motor operably coupled to the rotatable drum and configured to control rotation of the rotatable drum.

9. The dryer of claim 8 wherein the controller is further operably coupled to the first motor and the blower motor and configured to selectively operate the first motor and the blower motor during dispensing of the at least one of the fabric-conditioning substances.

10. The dryer of claim 9 wherein the controller is configured to rotate the rotatable drum and cease operation of the blower motor during dispensing of the at least one of the fabric-conditioning substances.

11. The dryer of claim 1, further comprising a user interface configured to provide at least one indication to a user of the dryer.

12. The dryer of claim 11 wherein the user interface is configured to notify the user when the at least one of the fabric-conditioning substances is being dispensed into the rotatable drum.

13. The dryer of claim 11 wherein the user interface is configure to indicate that the dryer is executing a cycle including one of a wrinkle removal cycle, an odor removal cycle, a fragrance addition cycle, an anti-static guard cycle, or a stain guard cycle.

14. The dryer of claim 11 wherein the user interface is configure to indicate a level of the at least one of the fabric-conditioning substances in a corresponding one of the multiple reservoirs.

15. The dryer of claim 11 wherein the user interface is configure to indicate to the user to refill or replace at least one of the multiple reservoirs.

16. The dryer of claim 1, further comprising a sensor configured to determine a presence of the at least one of the fabric-conditioning substances within at least one of the multiple reservoirs and provide an output indicative thereof.

17. The dryer of claim 1, further comprising a sensor operably coupled to the controller and configured to determine the type of the at least one of the fabric-conditioning substances within at least one of the multiple reservoirs and provide an output indicative thereof to the controller.

18. The dryer of claim 17, further comprising a user interface configured to notify a user of the type of the at least one of the fabric-conditioning substance being dispensed into the rotatable drum.

19. The dryer of claim 17 wherein the dispensing system further comprises a delivery apparatus and at least one of a duty cycle or a speed of the delivery apparatus is selected by the controller according to the type of the at least one of the fabric-conditioning substances.

* * * * *